US005367727A

United States Patent [19]

Dyer, Jr.

[11] Patent Number: 5,367,727

[45] Date of Patent: Nov. 29, 1994

[54] FLOTATION BED WITH ENHANCED POSTURAL SUPPORT

[75] Inventor: Charles D. Dyer, Jr., Dallas, Tex.

[73] Assignee: Valwhat Enterprises, Inc., Dallas, Tex.

[21] Appl. No.: 957,713

[22] Filed: Oct. 7, 1992

[51] Int. Cl.[5] ..... A47C 27/08; A47C 27/18

[52] U.S. Cl. ..... 5/451; 5/470; 5/901

[58] Field of Search ..... 5/451, 450, 449, 452, 5/470, 917, 901, 464, 481

[56] References Cited

U.S. PATENT DOCUMENTS

| | | | |
|---|---|---|---|
| 3,197,357 | 7/1965 | Schulpen | 5/481 |
| 4,187,566 | 2/1980 | Peterson | 5/451 |
| 4,999,868 | 3/1991 | Kraft | 5/481 |
| 5,077,848 | 1/1992 | McDaniel et al. | 5/451 |
| 5,086,528 | 2/1992 | Miller | 5/451 |
| 5,109,559 | 5/1992 | West | 5/470 |

*Primary Examiner*—Alexander Grosz
*Attorney, Agent, or Firm*—Groover & Bruning

[57] ABSTRACT

A waterbed structure, in which added lumbar support is provided by a padded cover atop the bag (which also provides extra thermal insulation and padding). The padded cover includes a sheet of convoluted foam which covers essentially the full length of the mattress. This sheet of convoluted foam is stiffened, over the middle part of the mattress length, by a complementary piece of convoluted foam which is mated with it. The increase in thickness caused by having two pieces of convoluted foam face-to-face is relatively small. Thus, this arrangement provides extra firmness under the torso, while maintaining an essentially flat upper surface.

22 Claims, 3 Drawing Sheets

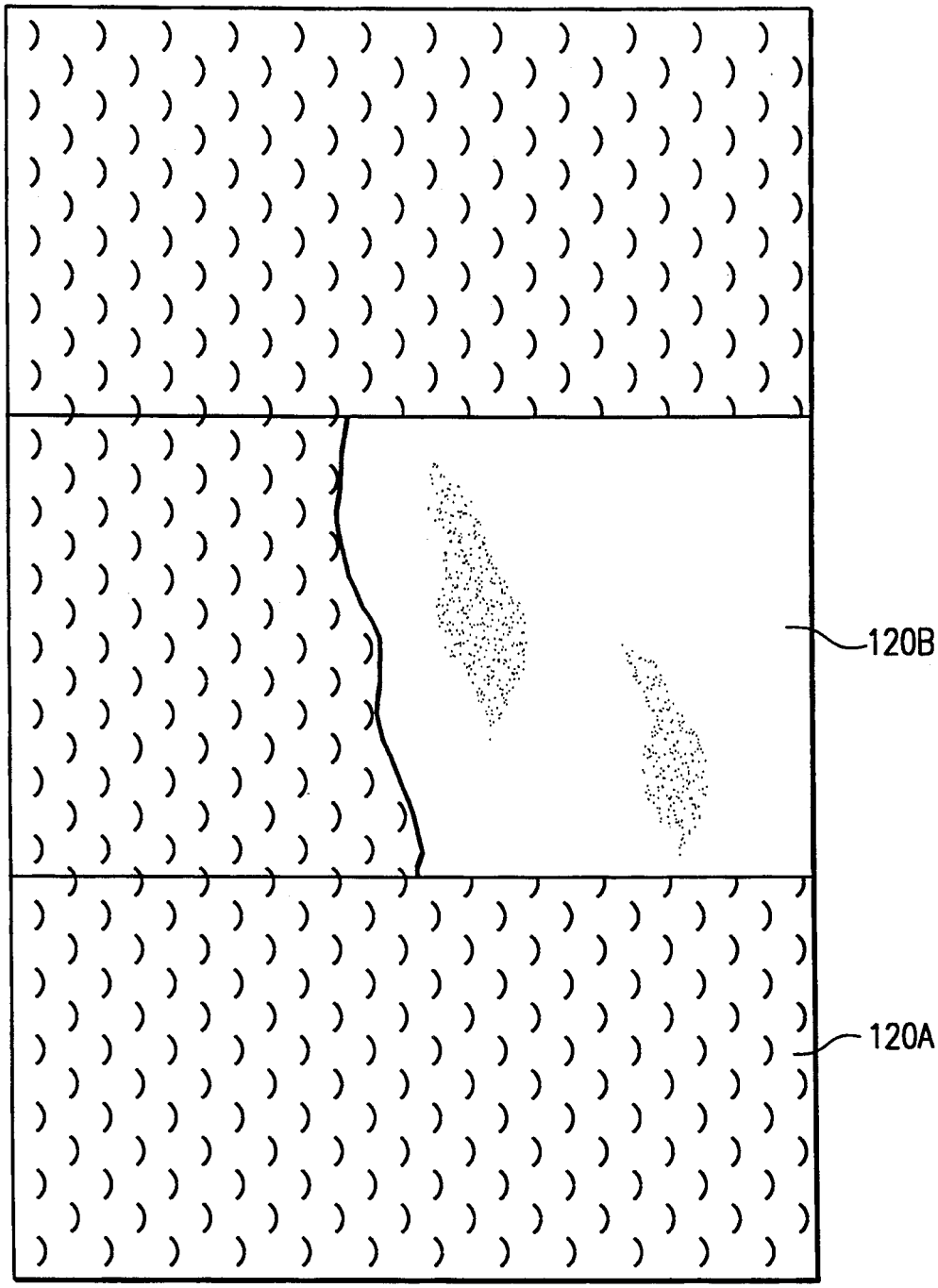
FIG. 2
FIG. 3
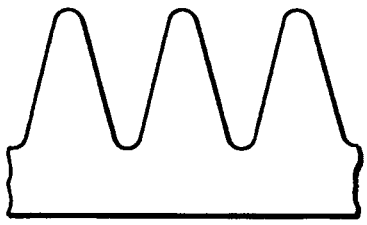

FLOTATION BED WITH ENHANCED POSTURAL SUPPORT

BACKGROUND AND SUMMARY OF THE INVENTION

The present invention relates to bedding, and particularly to flotation mattresses and waterbeds.

Waterbeds have become a very popular form of bedding within the last two decades. They provide an extremely soft and comfortable surface, they are relatively inexpensive, and they are readily portable. However, one continuing problem of waterbeds has been the difficulty of providing adequate support to maintain good posture in the sleeper.

A waterbed, at its simplest, is a rectangular bag (typically of vinyl), filled with water to a thickness of 3 to 9 inches. When such a bag is laid on a flat surface, it will easily support a person's weight, and thus can serve as a mattress. (Indentation is resisted not only by simple flotation, but also by the tension of the top surface of the mattress.)

A great deal of development has gone into improving this basic waterbed idea. For example, waterbeds now commonly include internal fiber, foam, or tubing to dampen sloshing. Various design improvements have also attempted to reduce the thermal coupling between the user's body and the water in the bag. For example, it is now common to provide a layer of foam atop the bag. (A host of other improvements have been made which are not particularly relevant to the claimed invention. For example, the bag is often thermostatically heated. In "hard-sided" bed structures (unlike those of the presently preferred embodiment) the complete waterbed may include a furniture structure which provides rigid sides to laterally confine the bag, and a fiat elevated platform for the bag to rest on, while maintaining the cosmetic appeal of good furniture. Numerous other improvements have been made to reduce sloshing or guard against leakage.)

Support

The support provided by a waterbed, to a sleeper in the middle of the waterbed, is provided by a combination of two components: the flotation provided by the liquid in the bag, and the sling effect provided by the lateral tensioning of the bag's top surface. This support structure provides a degree of support which is fairly soft and fairly uniform. The softness of the waterbed is a health and comfort advantage, since it avoids points of high pressure. The occurrence of pressure points will not only be uncomfortable, but will also reduce blood circulation in the affected areas. The importance of this may be seen, for example, in bedridden patients, where decubitus sores (bedsores) are a major health problem.

However, soft bedding also causes a problem, because the weight distribution of the human body is not at all uniform. The highest concentration of mass (per unit length in the height axis) will be between the shoulder blades and the hips. The mass per unit length is generally lower at the head, and is much lower in the legs. (The weight distribution is, of course, different from person to person, depending on the person's age, height, sex, obesity, and general body type. However, the problems discussed are problems for a very large fraction of users.) Thus, if the mattress is filled to a comfortable thickness for most of the body, the user's hips or buttocks will tend to sink excessively far into the mattress. (Spinal alignment, in a good sleeping posture, should be the same as that in a good standing posture. Thus, a sleeper should be supported so that his or her spine will be laterally straight, and will be curved with no more (and no less) than normal lumbar and thoracic arch and pelvic tilt. Distortions of this sleeping posture will produce immediate or gradual discomfort, and may not be optimal for the sleeper's health.) This problem is exacerbated when the mattress is used by two persons sleeping together.

This deficit in support will tend to reduce the user's comfort, to a greater or lesser degree depending on the user. However, a more important effect is that this deficit in support may permit a user to sleep in a condition of postural misalignment. This may lead to backaches, or to vague discomforts which reduce the user's overall level of health and well-being.

Some efforts have been made to increase the support under the torso. (For example, the "System 750" waterbed, from Land and Sky, includes a floating fiber structure, inside the bag, which is thicker under the user's midsection to provide additional back support. U.S. Pat. No. 5,077,848 (to McDaniel et al.) discloses an immersed tube structure, with foam inserts in the tube. The "Avanti III" model, from Pleasant Rest, is a waterbed with a foam topping, which includes extra layers of fiber (under a single sheet of foam) under the user's midsection to provide added lumbar support. The "Marvelous Middle" from Restonic includes stiffer springs in the middle of the mattress. The cover itself includes extra lines of stitching, under the sleeper's midsection, which give the impression that the middle of the cover is different from the rest of the cover, but in fact (insofar as is known to the present inventor) the cover is uniform over its length, and does NOT include any additional material under the sleeper's midsection.) Many of these have used immersed structures (inside the bag), which are prone to degradation and waterlogging over time, and cannot readily be repaired or replaced.

Apart from the art of waterbeds, other attempts have been made to design sleeping pads with some allowance for the uneven weight distribution of the human body. Many of these attempts have used convoluted foam, which is one of the basic structural materials used in designing bedding structures. (Convoluted foam (in which one surface is carved into a rippled or egg-canon shape) is effectively softer than a solid block of foam of equivalent height, because the individual protrusions in the carved portion have more room to expand laterally under pressure. Convoluted foam is described, for instance, in U.S. Pat. No. 3,026,544 to Persicke et al., which is hereby incorporated by reference. Some of the attempts to use convoluted foam pads for sleeping structures are shown in U.S. Pat. No. 4,620,337 to Williams et al.; U.S. Pat. No. 4,955,096 to Gilroy et al.; and U.S. Pat. No. 4,879,776 to Farley; all of which are hereby incorporated by reference.)

Compatibility with Bedding Materials

As noted above, waterbeds have gradually increased in acceptance, to the point where a large fraction of the U.S. residential beds are waterbeds. However, one of the difficulties still retarding waterbed acceptance is the fact that traditional sheets and blankets, and traditional methods of making up a bed, are not quite optimal for a waterbed. To some extent this difficulty is unavoidable, since the waterbed is inherently less rigid and very much heavier than the traditional box spring and mattress set. However, compatibility with the traditional "look" of a bed is an important factor in design and marketing.

One important step toward compatibility with traditional bedding is in the "soft-sided" waterbed. This bed design includes a sidewall structure of relatively stiff foam which defines the location of the water bag. (The sidewall structure may be, for example, 3 inches wide at the level of the top of the bag, tapering to 7 inches wide at the level of the base of the bag. Alternatively, it may be, for example,3½" wide over the whole height of the bag.) An underlying layer of foam defines the relative positions of the sidewalls.

These sidewalls not only provide more rigid sides and corners for the bag when full (and thus help permit the use of traditional bedding), but also make the waterbed mattress appear very similar to a conventional mattress when empty.

Innovative Waterbed and Pad Structure

The present invention provides an improved waterbed structure, in which added lumbar support is provided by a padded cover atop the bag (which also provides extra thermal insulation and padding).

The padded cover includes a sheet of convoluted foam which covers essentially the full length of the mattress. This sheet of convoluted foam is stiffened, over the middle part of the mattress length, by a complementary piece of convoluted foam which is mated with it. The increase in thickness caused by having two pieces of convoluted foam face-to-face is relatively small. Thus, this arrangement provides extra firmness under the torso, while maintaining an essentially flat upper surface.

BRIEF DESCRIPTION OF THE DRAWING

The present invention will be described with reference to the accompanying drawings, which show important sample embodiments of the invention and which are incorporated in the specification hereof by reference, wherein:

FIG. 2 is a bottom view (with partial cutaway) of the two-piece support structure, using two pieces of convoluted foam, of the presently preferred embodiment.

FIG. 3 is a schematic detail view of the shape and typical dimensions of a sample convoluted foam structure.

DESCRIPTION OF THE PREFERRED EMBODIMENTS

The numerous innovative teachings of the present application will be described with particular reference to the presently preferred embodiment. However, it should be understood that this class of embodiments provides only a few examples of the many advantageous uses of the innovative teachings herein. In general, statements made in the specification of the present application do not necessarily delimit any of the various claimed inventions. Moreover, some statements may apply to some inventive features but not to others.

FIG. 3 is a schematic detail view of the shape and typical dimensions of a sample convoluted foam structure. The foam actually used, in the presently preferred embodiment, is an open-cell foam of polyurethane composition, of about 1 pound per cubic foot bulk density. The "ILD" parameter (indentation load deflection) is about 30, in the presently preferred embodiment. The convoluted shape used has a base thickness of ½", and an overall height of 1½". (Thus, when two pieces of foam are mated together, their overall thickness is only 2 inches.)

Figure 1:
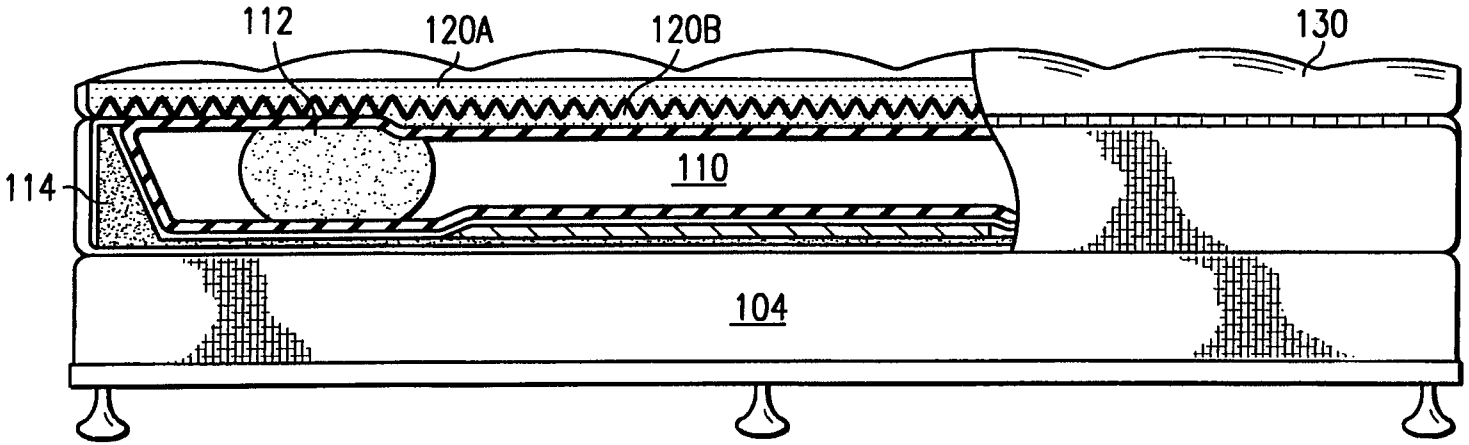
FIG. 1 is a sectional view of the waterbed mattress structure of the presently preferred embodiment.

FIG. 1 is a sectional view of the waterbed structure of the presently preferred embodiment. A foundation 104 supports the mattress structure at a conventional height. Bag 110 is filled with water, and also (in this sample embodiment) contains fibrous material 112 for dampening wave motion. Bag 110 is dimensioned to a standard mattress size, e.g. queen size or king size. Bag 110, in the presently preferred embodiment, is made of virgin vinyl, 18–24 mils (0.018–0.024") thick (20 mils in the presently preferred embodiment).

Bag 110 is laterally surrounded by a sidewall support structure 114, made of higher-density flexible foam. In the presently preferred embodiment, this sidewall support structure has a density of 1.5 ppcf, and an ILD of 65.

Foam padding 120A and 120B lies atop the bag 110. Foam piece 120A extends over the full width and length of the filled bag, and lies with its points down. Foam piece 120B covers the full width of the bag, but covers only the middle third (approximately) of the length of the bag. Foam piece 120B lies with its points up, so that pieces 120A and 120B are mated together over the entire area of piece 120B.

A polypropylene-damask cover 130 holds the foam padding 120 in place, and also includes additional top padding for comfort. (Of course, the cover can alternatively include other materials, such as wool batting, knit, chintz, or other fabric.) This cover is shaped as a complete zip-on enclosure, in the presently preferred embodiment; but alternatively the cover could be configured as a separable two-piece structure if desired. The foam pads 120 are glued to the cover 130, in the presently preferred embodiment, but alternatively they could be quilted to it, attached in other ways, or simply be emplaced loose to be retained by the pressure of the cover.

FIG. 2 is a bottom view (with partial cutaway) of the two-piece support structure, using two pieces of convoluted foam, of the presently preferred embodiment.

Sleepers of different heights will typically align themselves to the head end of the mattress, and the following sample dimensions take account of this. However, of course, these dimensions can be made symmetrical (so that head-foot reversal will not affect them), or otherwise altered in a variety of ways.

For example, for a king-size mattress, the dimensions of the elements described above, in the presently preferred embodiment, are: top foam padding piece 120A: 76" wide by 80" long; bottom foam padding piece 120B: 68" wide by 26" long.

Thus, the unsupported length of top piece 120A at the head end is 23 inches, and the unsupported length of top piece 120A at the foot end is 31 inches.

Figure 4:
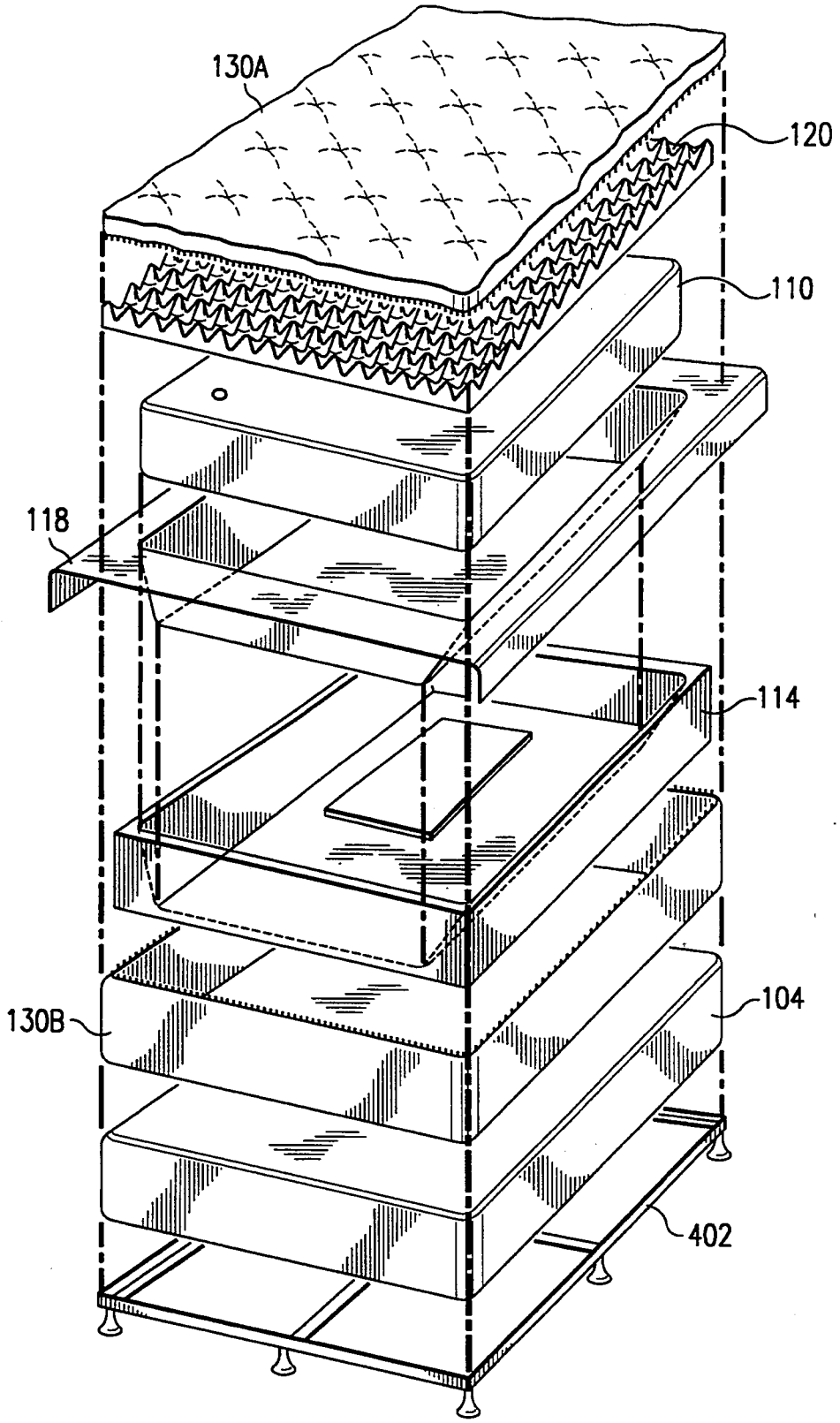
FIG. 4 is an exploded view of a sample soft-sided waterbed structure, showing the complete context in which the structure of FIG. 1 is used, in a sample embodiment.

FIG. 4 is an exploded view of a sample soft-sided waterbed structure, showing the context in which the structure of FIG. 1 is used, in a sample embodiment.

A heavy duty metal frame 402 rests on the floor, and supports a foundation 104. The foundation 104, in the presently preferred embodiment, is simply a wood-framed structure, with a quilted cover on it, which provides a flat top surface strong enough to support the weight of the waterbed mattress.

The cover 130 includes a top portion 130A and a bottom portion 130B, which are zipped together by a horizontal circumferential zipper 132. The cover 130 encloses the sidewall support structure 114. (Note that the sidewall support structure includes a bottom portion, extending the full width of the bed, to resist the spreading forces due to the lateral pressure of the bag.) A heater 116 (optional), a liner 118, and the bag 110, all lie within the well of support structure 114.

Foam padding 120, made of a two-layer structure as shown in FIGS. 1 and 2 (but not in FIG. 4), lies atop the bag 110, and is enclosed by cover 130.

Of course, the specific structure of FIG. 4 is not strictly necessary for the practice of the invention.

Further Modifications and Variations

It will be recognized by those skilled in the art that the innovative concepts disclosed in the present application can be applied in a wide variety of contexts. Moreover, the preferred implementation can be modified in a tremendous variety of ways. Accordingly, it should be understood that the modifications and variations suggested below and above are merely illustrative. These examples may help to show some of the scope of the inventive concepts, but these examples do not nearly exhaust the full scope of variations in the disclosed novel concepts.

For example, although the presently preferred embodiment uses soft-sided bed structure, the disclosed innovations can also, alternatively and less preferably, be adapted to a hard-sided structure.

For another example: the convoluted foam is in an egg-carton pattern, in the presently preferred embodiment. However, a ripple pattern, or another self-complementary pattern, or a pair of different but complementary patterns, could alternatively be used instead.

Of course, the dimensions and material compositions of the presently preferred embodiment have been specified merely for full compliance with the best mode requirements, and can be widely modified and varied.

One contemplated class of alternative embodiments provides an insert for hardside waterbeds, which incorporates enhanced postural support as described above.

As will be recognized by those skilled in the art, the innovative concepts described in the present application can be modified and varied over a tremendous range of applications, and accordingly the scope of patented subject matter is not limited by any of the specific exemplary teachings given.

What is claimed is:

1. A flotation bed, comprising:

a waterproof bag, having a substantially rectangular top surface of substantially predetermined width and length when substantially full;

a first foam pad, having at least one convoluted surface, and having one horizontal dimension at least equal to 80% of said predetermined width, and having another horizontal dimension at least equal to 80% of said predetermined length;

a second foam pad, having at least one convoluted surface, and having one horizontal dimension at least equal to 80% of said predetermined width, and having another horizontal dimension less than 79% of said predetermined length;

said first and second foam pads being mated together with respective convoluted surfaces thereof facing together, and positioned atop said bag;

a cover, removably fastened atop said bag, and holding said pads in place atop said bag.

2. The flotation bed of claim 1, wherein said bag comprises multiple separate watertight compartments.

3. The flotation bed of claim 1, wherein said convoluted surface of said first foam pad and said convoluted surface of said second foam pad are both convoluted with the same pattern.

4. The flotation bed of claim 1, wherein said convoluted surface of said first foam pad and said convoluted surface of said second foam pad are both convoluted with an egg-carton pattern.

5. The flotation bed of claim 1, further comprising a support structure which has rigid sidewalls and laterally surrounds said bag.

6. The flotation bed of claim 1, further comprising a foam support structure which laterally surrounds said bag.

7. The flotation bed of claim 1, wherein said first and second foam pads are upholstered into said cover, and are concealed from view, and are not directly in contact with said bag.

8. The flotation bed of claim 1, wherein said predetermined width and length correspond to a queen size bed.

9. A flotation bed, comprising:

a waterproof bag, having a top surface of substantially predetermined width and length;

a first polymer foam pad, having at least one convoluted surface, and having one horizontal dimension at least equal to 80% of said predetermined width, and having another horizontal dimension at least equal to 80% of said predetermined length;

a second polymer foam pad, having at least one convoluted surface, and having one horizontal dimension at least equal to 80% of said predetermined width, and having another horizontal dimension substantially less than 65% of said predetermined length;

said first and second foam pads being mated together with respective convoluted surfaces thereof facing together, and positioned atop said bag;

a polymer foam sidewall structure, laterally surrounding said bag to provide lateral support therefor;

a cover, removably fastened to enclose said bag and said foam sidewall structure, and holding said pads in place atop said bag.

10. The flotation bed of claim 9, wherein said bag comprises multiple separate watertight compartments.

11. The flotation bed of claim 9, wherein said convoluted surface of said first foam pad and said convoluted surface of said second foam pad are both convoluted with the same pattern.

12. The flotation bed of claim 9, wherein said convoluted surface of said first foam pad and said convoluted surface of said second foam pad are both convoluted with an egg-carton pattern.

13. The flotation bed of claim 9, wherein said first and second foam pads are upholstered into said cover, and are concealed from view, and are not directly in contact with said bag.

14. The flotation bed of claim 9, wherein said predetermined width and length correspond to a queen size bed.

15. The flotation bed of claim 9, further comprising a waterproof flexible liner sheet interposed between said bag and said sidewall structure.

16. A flotation bed, comprising:

a waterproof bag, having a substantially rectangular top surface of substantially predetermined width and length when substantially full;

a first foam pad overlying said bag, having at least one convoluted surface, and having a width approximately equal to at least 80% of said predetermined width, and having a length approximately equal to at least 80% of said predetermined length;

a second foam pad, having at least one convoluted surface, and having a width approximately equal to at least 80% of said width of said first foam pad, and having a length less than 60% of said length of said first foam pad;

said first and second foam pads being mated together with respective convoluted surfaces thereof facing together, and positioned atop said bag;

a cover, removably fastened atop said bag and atop said first and second foam pads.

17. The flotation bed of claim 16, wherein said bag comprises multiple separate watertight compartments.

18. The flotation bed of claim 16, wherein said convoluted surface of said first foam pad and said convoluted surface of said second foam pad are both convoluted with the same pattern.

19. The flotation bed of claim 16, wherein said convoluted surface of said first foam pad and said convoluted surface of said second foam pad are both convoluted with an egg-carton pattern.

20. The flotation bed of claim 16, further comprising a support structure which has rigid sidewalls and laterally surrounds said bag.

21. The flotation bed of claim 16, wherein said first and second foam pads are upholstered into said cover, and are concealed from view, and are not directly in contact with said bag.

22. The flotation bed of claim 16, wherein said first and second foam pads are glued to said cover.

* * * * *